US010321769B2

(12) United States Patent
Longenecker et al.

(10) Patent No.: US 10,321,769 B2
(45) Date of Patent: Jun. 18, 2019

(54) CLIP-ON CHILD BOOSTER SEAT

(71) Applicant: ARTSANA USA, INC., Lancaster, PA (US)

(72) Inventors: Michael L. Longenecker, Lancaster, PA (US); Stephen J. Wood, Kutztown, PA (US)

( * ) Notice: Subject to any disclaimer, the term of this patent is extended or adjusted under 35 U.S.C. 154(b) by 0 days.

(21) Appl. No.: 15/816,362

(22) Filed: Nov. 17, 2017

(65) Prior Publication Data

US 2018/0146793 A1 May 31, 2018

Related U.S. Application Data

(60) Provisional application No. 62/427,762, filed on Nov. 29, 2016.

(51) Int. Cl.
*A47D 1/02* (2006.01)
*A47D 1/00* (2006.01)
*A47D 1/10* (2006.01)

(52) U.S. Cl.
CPC ..... *A47D 1/02* (2013.01); *A47D 1/006* (2013.01); *A47D 1/106* (2013.01)

(58) Field of Classification Search
CPC ..... A47D 1/02; A47D 1/106; A47D 1/006
USPC ..... 297/174 CS, 250.1, 251, 252, 253, 254, 297/255, 256, 256.1, 256.11, 256.12, 297/256.13, 256.14, 256.15, 256.16, 297/256.17
See application file for complete search history.

(56) References Cited

U.S. PATENT DOCUMENTS

| | | | |
|---|---|---|---|
| 2,707,987 | A | 5/1955 | Gibson |
| 3,126,226 | A | 3/1964 | Johnson |
| 4,568,120 | A | 2/1986 | Hoffman |
| 4,629,247 | A | 12/1986 | Wu |

(Continued)

FOREIGN PATENT DOCUMENTS

| | | |
|---|---|---|
| CN | 2157707 | 3/1993 |
| JP | 613620 | 7/1992 |

*Primary Examiner* — Justin V Lewis
(74) *Attorney, Agent, or Firm* — Patent Law Associates

(57) ABSTRACT

A foldable seat frame for attachment to a table surface for supporting a young child. The frame comprises a pivotally a pair of members coupled in an X-shape. Contact members are provided on adjacent opposing ends of the frame members on a first side of the pivot connection configured for adjacent contact with top and bottom surfaces of the table. Lower contact members positioned adjacent to the bottom surface are movable between a first position generally parallel to the table surface and second position slightly over-center of a generally perpendicular alignment to the table surface. When the lower contact members are in the first position, the seat frame may be easily detached from a table having downardly extending a peripheral skirt structure without requiring large pivoting movement of the frame. When the lower contact members are in the second position, they extend upwardly toward the lower table surface to reduce the degree of frame pivoting movement necessary to clamp the frame to the table. A tension device is connected between adjacent opposing ends of the frame disposed on the opposite side of the pivot connection to draw the opposing ends toward each other which coincidentally draws the contact members closer and thereby enables the table to be clamped therebetween.

18 Claims, 8 Drawing Sheets

(56) References Cited

U.S. PATENT DOCUMENTS

| | | | | |
|---|---|---|---|---|
| 4,818,016 | A | 4/1989 | Mariol et al. | |
| 4,844,537 | A | 7/1989 | Reed | |
| 5,415,456 | A * | 5/1995 | Hart | A47D 1/02<br>297/135 |
| 6,736,451 | B1 | 5/2004 | Chen | |
| 7,823,520 | B2 | 11/2010 | Mayben | |
| 2007/0040430 | A1 | 2/2007 | Flannery | |

* cited by examiner

CLIP-ON CHILD BOOSTER SEAT

CROSS-REFERENCE TO RELATED APPLICATIONS

This application claims the priority benefit of U.S. provisional patent application Ser. No. 62/427,762 filed on Nov. 29, 2016.

BACKGROUND OF THE INVENTION

This invention relates generally to portable seating for small children, and more particularly to a collapsible seat that may be conveniently attached to a table or the like, including tables having a skirt or apron extending below the table surface adjacent to the table surface perimeter.

Portability of infant care accessories is an increasingly important consideration among consumers. Foldable seat frames that conveniently clamp to a table are well-known in the art, known frames generally lack the ability to be effectively clamped to a table that includes a downwardly extending skirt or apron proximate to the edge of the table surface. Existing frames that accommodate such installations generally do so with compromises to the compactness and ease of use (e.g., attachment to and removal from the table) when they are removed and folded for stowage. Consequently, the need to improve compactness, stability when installed, and ease of use of foldable seat frames is a growing concern. Many benefits would be realized by a foldable seat frame that is conveniently attachable to a table surface, even one including a substantial downwardly extending apron, secure when attached, easily removable, and collapsible into a compact form when removed.

SUMMARY OF THE INVENTION

Accordingly, the present invention, in any of the embodiments described herein, may provide one or more of the following advantages:

It is an object of the present invention to provide a foldable seat frame for attachment to a table surface adjacent an edge of the surface that provides a seat proximate to the table surface suitable for a young child. The frame comprises a pair of frame portions pivotally coupled to form a generally X-shaped frame. Contact members are provided on adjacent opposing ends of the frame disposed on a first side of the pivot connection, the contact members configured for adjacent contact with opposing upper and lower surfaces of a table. A tension device is connected between adjacent opposing ends of the frame disposed on the opposite side of the pivot connection, the tension device configured to draw the opposing ends toward each other which coincidentally draws the contact members closer and thereby enables the table to be clamped therebetween.

It is a still further object of the present invention to provide a foldable seat frame for attachment to a table surface adjacent an edge of the surface that provides a seat proximate to the table surface suitable for a young child wherein the table further includes a downwardly extending apron or skirt structure proximate to the table surface edge. Contact members are provided on adjacent opposing ends of the frame disposed on a first side of the pivot connection, the contact members configured for adjacent contact with opposing upper and lower surfaces of a table. Lower contact members positioned adjacent to the lower table surface are movable between a first position generally parallel to the table surface and second position generally perpendicular to the table surface. When the lower contact members are in the first position, the seat frame may be easily detached from the table without requiring large pivoting movement of the frame. When the lower contact members are in the second position, they extend upwardly toward the lower table surface to reduce the degree of frame pivoting movement necessary to clamp the frame to the table.

It is a further object of the present invention to provide a foldable seat frame for attachment to a table surface adjacent an edge of the surface that provides a seat proximate to the table surface suitable for a young child wherein the table further includes a downwardly extending apron or skirt structure proximate to the table surface edge. Lower contact members positioned adjacent to the lower table surface are movable between a first position generally parallel to the table surface and second position generally perpendicular to the table surface. When positioned to extend upwardly toward the lower table surface, the lower contact members may be angled slightly or an offset contact foot may be provided on the ends of the lower contact members to create a slight over-center relationship in the movement between first and second positions so that movement from the second position is inhibited once the seat frame is clamped to the table thereby improving lateral stability of the frame.

It is a still further object of the present invention to provide a foldable seat frame for attachment to a table surface suitable for use by a young child that is durable in construction, inexpensive of manufacture, carefree of maintenance, easily assembled, and simple and effective to use.

These and other objects are achieved in accordance with the present invention by providing a foldable seat frame for attachment to a table surface adjacent an edge of the table surface for positioning a young child proximate to the table surface. The frame is configured for attachment to a table which further includes a downwardly extending apron or skirt structure proximate to the table surface edge adjacent to the seat attachment. The frame comprises a pair of frame portions pivotally coupled to form a generally X-shaped frame. Contact members are provided on adjacent opposing ends of the frame disposed on a first side of the pivot connection, the contact members configured for adjacent contact with opposing upper and lower surfaces of a table. Lower contact members positioned adjacent to the lower table surface are movable between a first position generally parallel to the table surface and second position generally perpendicular to the table surface. When the lower contact members are in the first position, the seat frame may be easily detached from the table without requiring large pivoting movement of the frame. When the lower contact members are in the second position, they extend upwardly toward the lower table surface to reduce the degree of frame pivoting movement necessary to clamp the frame to the table. A tension device is connected between adjacent opposing ends of the frame disposed on the opposite side of the pivot connection, the tension device configured to draw the opposing ends toward each other which coincidentally draws the contact members closer and thereby enables the table to be clamped therebetween.

BRIEF DESCRIPTION OF THE DRAWINGS

The advantages of this invention will be apparent upon consideration of the following detailed disclosure of the invention, especially when taken in conjunction with the accompanying drawings wherein.

DESCRIPTION OF THE PREFERRED EMBODIMENT(S)

Many of the fastening, connection, processes and other means and components utilized in this invention are widely known and used in the field of the invention described, and their exact nature or type is not necessary for an understanding and use of the invention by a person skilled in the art, and they will not therefore be discussed in significant detail. Also, any reference herein to the terms "up" or "down," or "top" or "bottom" are used as a matter of mere convenience, and are determined as the seat frame would normally be positioned when clamped to a table surface to support a child. Furthermore, the various components shown or described herein for any specific application of this invention can be varied or altered as anticipated by this invention and the practice of a specific application of any element may already be widely known or used in the art by persons skilled in the art and each will likewise not therefore be discussed in significant detail. When referring to the figures, like parts are numbered the same in all of the figures.

Figure 1:
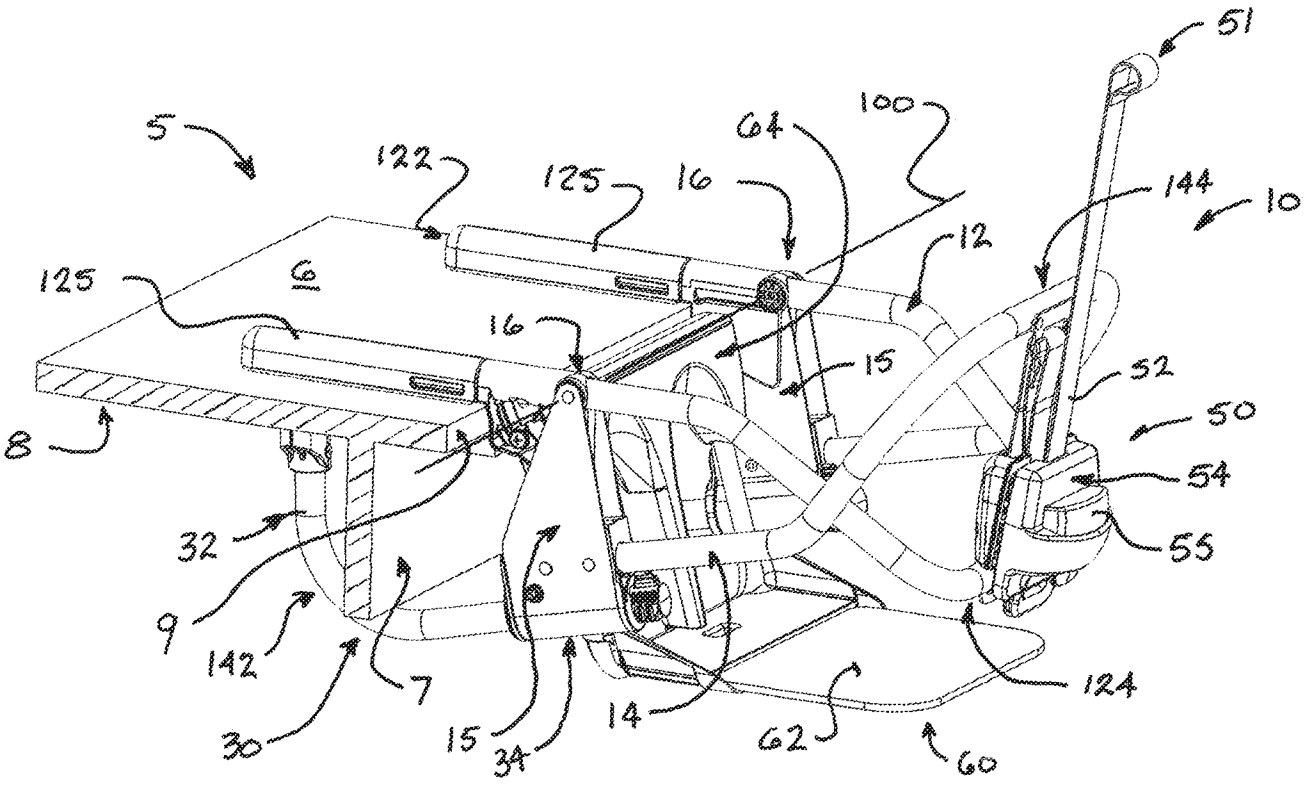
FIG. 1 is a perspective view of a foldable seat frame for a child shown attached to a conventional table having a downwardly extending perimeter apron.
Figure 2:
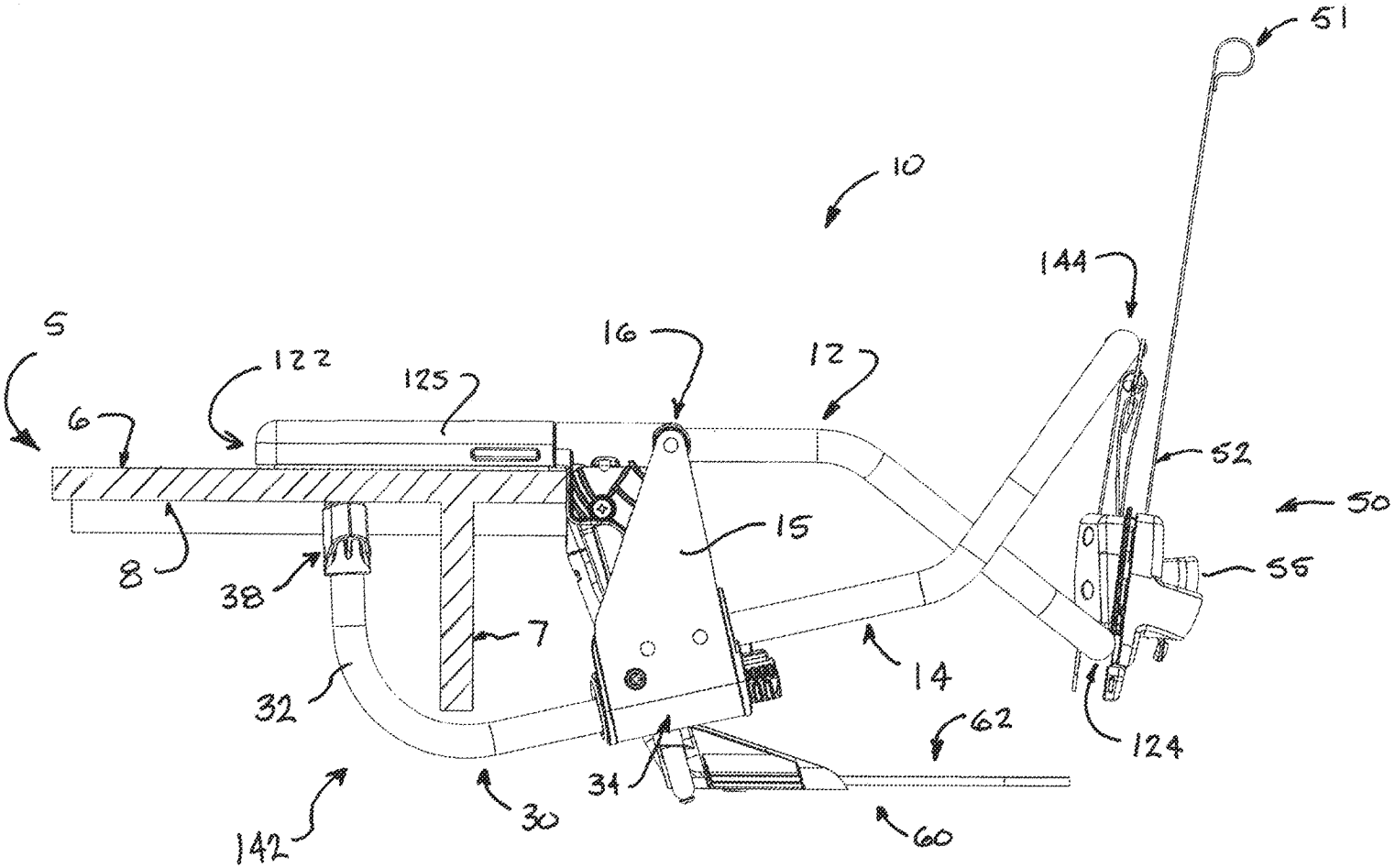
FIG. 2 is a side view of the foldable seat frame shown in FIG. 1.

Referring to the figures, and FIGS. 1 and 2 in particular, a foldable seat frame 10 embodying the present invention is shown positioned for use by attachment to a conventional table 5 having an upper surface 6 and a lower surface 8, the lower surface 8 including a downwardly extending apron 7 adjacent to an edge 9 of the table. The frame 10 comprises a first portion 12 and a second portion 14 that are coupled at a hinge 16 that enables relative movement between the two portions about a hinge axis 100. The frame portions 12, 14 may be generally U-shaped to create a seating space between the extensions.

The hinge axis 100 is positioned intermediately between opposing inward and outward ends 122, 124 of the first portion 12 and opposing inward and outward ends 142, 144 of the second portion 14. The frame portions 12, 14 are configured in a crossing or scissor-like arrangement so that the adjacent inward ends 122, 142 move toward each other simultaneous with movement of the outward ends 124, 144 towards each other. The frame portions 12, 14 may also include offset structures 15 to provide the spatial relationship between the first and second frame portions to accommodate seating of a child partially within the frame 10.

A securing apparatus 50 is provided connecting the adjacent outward ends 124, 144 of the first and second portions. The securing apparatus 50 may be in the form of a tensioning belt 52 which connects the adjacent first and second outward ends 124, 144 and allows them to be drawn toward each other. The securing apparatus 50 further comprises a releasable ratchet mechanism 54 which enables the tensioning belt 52 to be moved in a first direction by pulling an end 51 of the belt 52, but requires that the ratchet mechanism 54 be released, preferably by a user accessible release actuator 55, before the belt 52 is permitted to move in a direction opposite of the first direction.

It is preferable for the hinge axis 100 to be disposed generally proximate to a midpoint of the overall length of the frame to provide a near-direct relationship between the tensioning force applied between the outward ends 124, 144 by the securing apparatus 50 and the clamping force applied to the table 5.

The inward ends 122, 142 of the frame portions 12, 14 are configured to be positioned in adjacent contact with opposing upper 6 and lower surfaces 8 so that the table 5 is disposed between the adjacent inward ends 122, 142. The securing apparatus 50 allows the outward ends 124, 144 to be drawn toward each other which causes the inward ends 122, 142 to also be drawn into closer proximity, clamping the table 5 therebetween.

Figure 3:
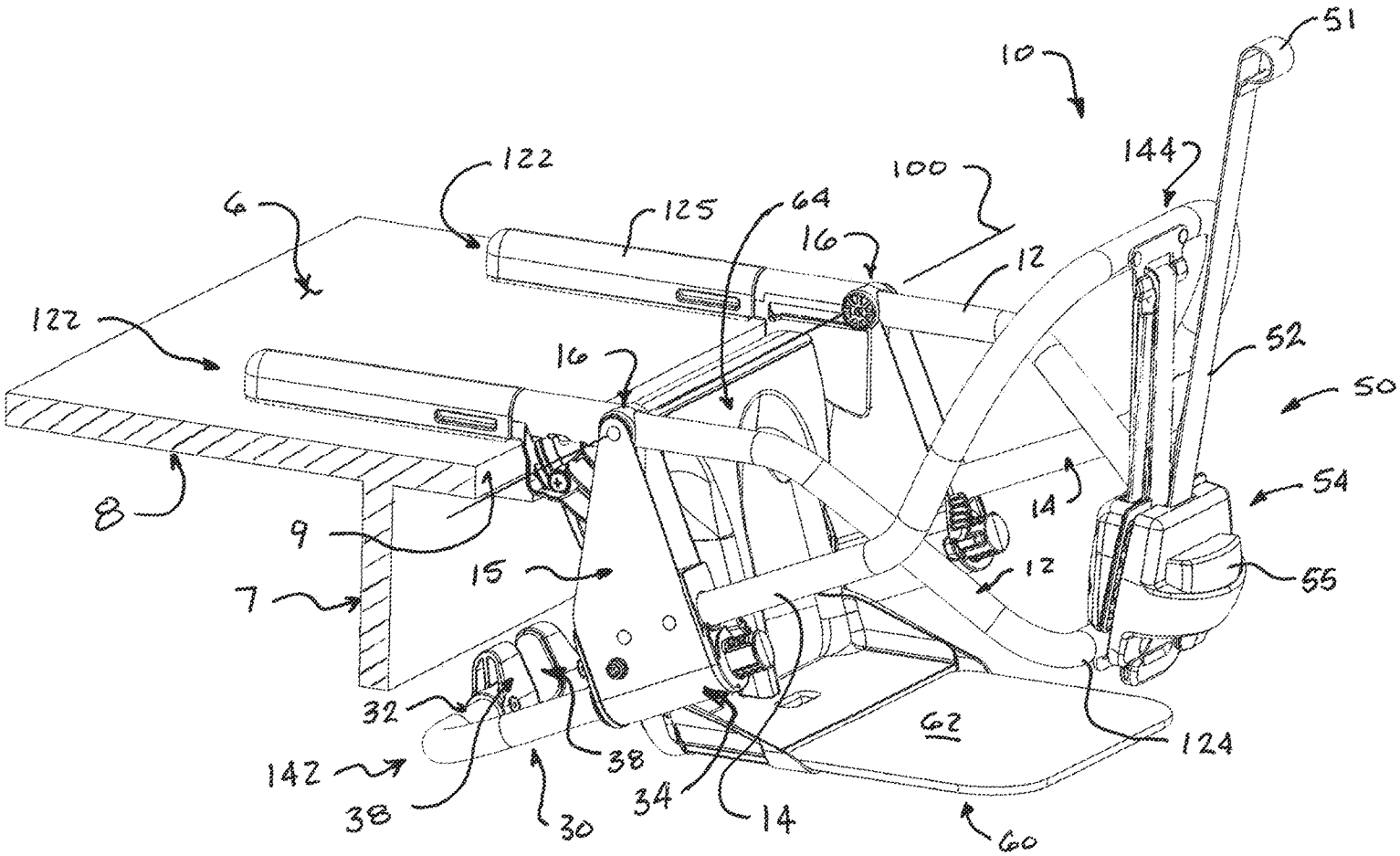
FIG. 3 is a perspective view of the foldable seat frame of FIG. 1 shown in a released configuration in preparation for detachment from the table.
Figure 4:
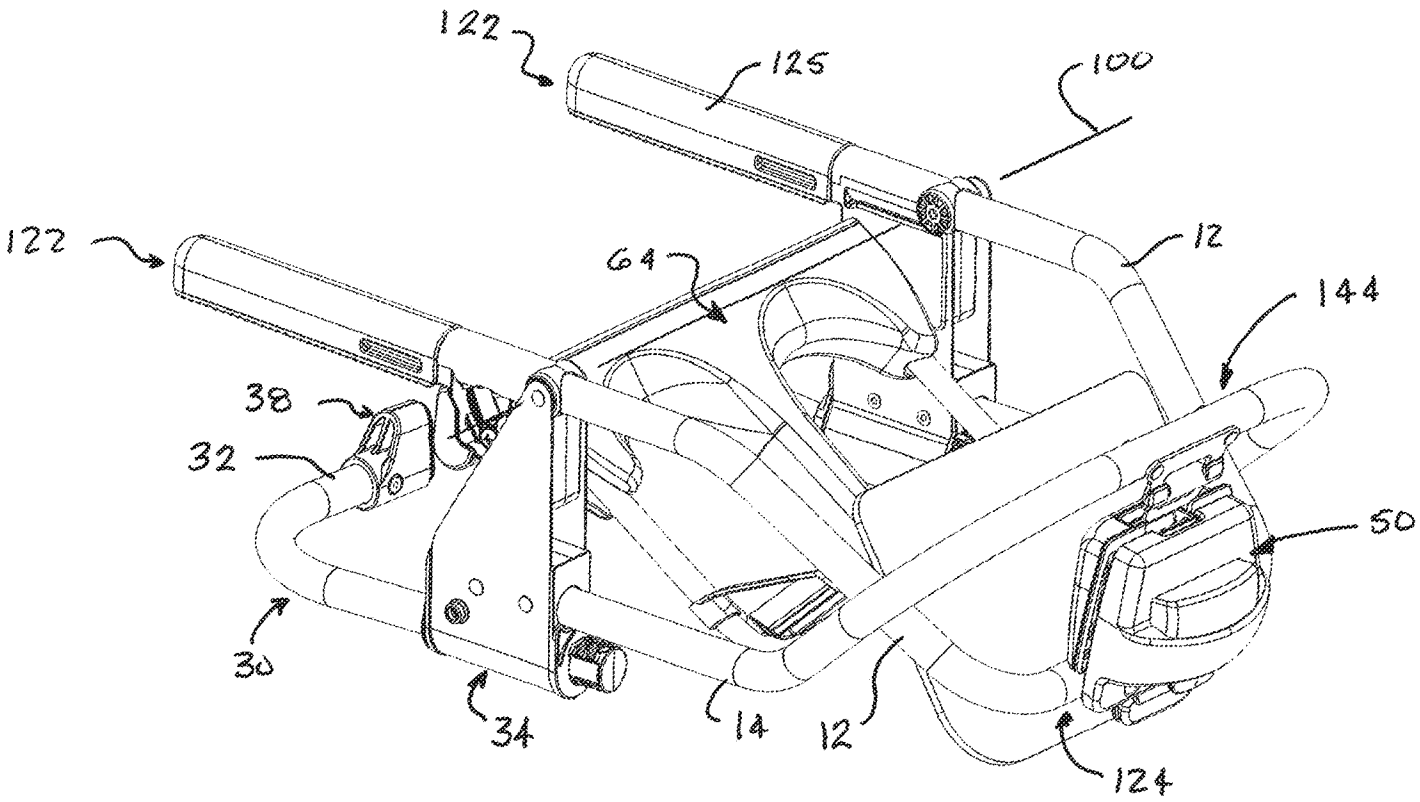
FIG. 4 is a perspective view of the foldable seat frame shown in FIG. 1 shown in a collapsed configuration for storage.

The inward ends 142 of the second frame portion 14 may be provided with clamping space adjusters 30 that permit the second portion of the frame 14 to be positioned below the downwardly extending apron 7 of the table 5 while extending upwardly to the lower surface 8 of the table. Each clamping space adjuster 30 comprises an extension 32 and a rotator connector 34 which rotatably couples the adjuster 30 to the second frame portion 14. The clamping space adjusters 30 may also replace the inward-most portion of the second frame portion 14, as is illustrated, by locating the rotator connectors 34 in the offset structures 15. The clamping space adjusters 30 are configured in a manner so that the extension 32 may be rotated between a first position, shown in FIGS. 1, 2, 7, and 8, and a second position, shown in FIGS. 3, 4 and 9. The space adjusters 30 are configured to rotate in opposite directions relative to one another when moving from the second position toward the first position to improve stability when clamped to the table. It is preferred for the extension 32 to be positioned in either of the extremes of rotation for use or removal as appropriate.

The clamping adjusters may be provided with features to permit the extensions 32 to be removed for additional compactness of the frame 10 when not in use. It is preferred that removal of the extensions 32 only be accomplished while in the second position. The rotator connector 34 may include tabs and channels, press buttons, or the like that are aligned to permit removal only when the extensions are aligned in the second position. Similarly, the inward ends of the first frame portion 12 may also be detachable by a user to further improve compactness of the folded frame when it is not in use.

Figure 8:
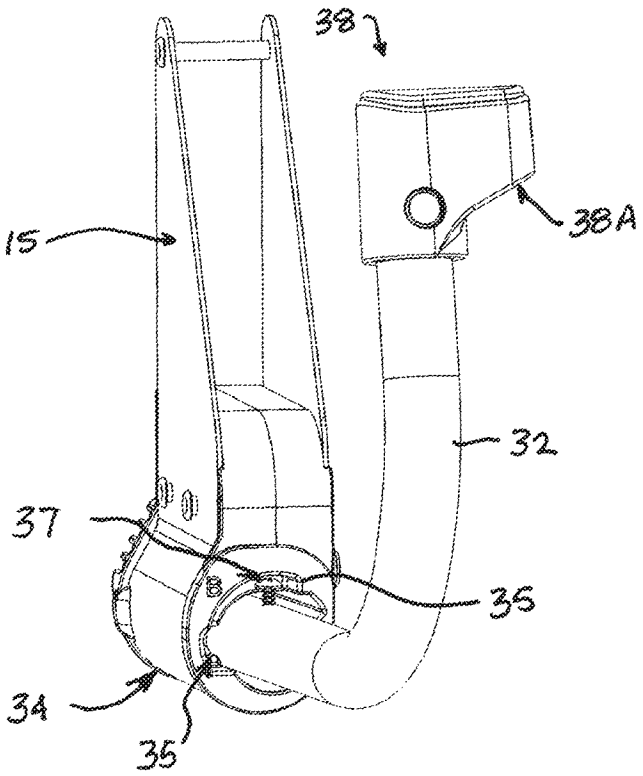
FIGS. 7 through 9 illustrate the opposing positions of folding extensions that enable the foldable seat frame to reach around a side apron on a table and clamp the table surface and to be easily removed therefrom.
Figure 7:
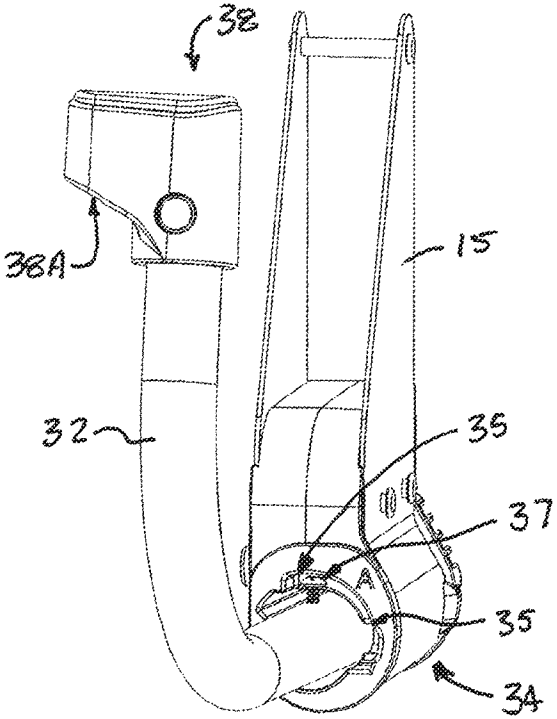
Figure 9:
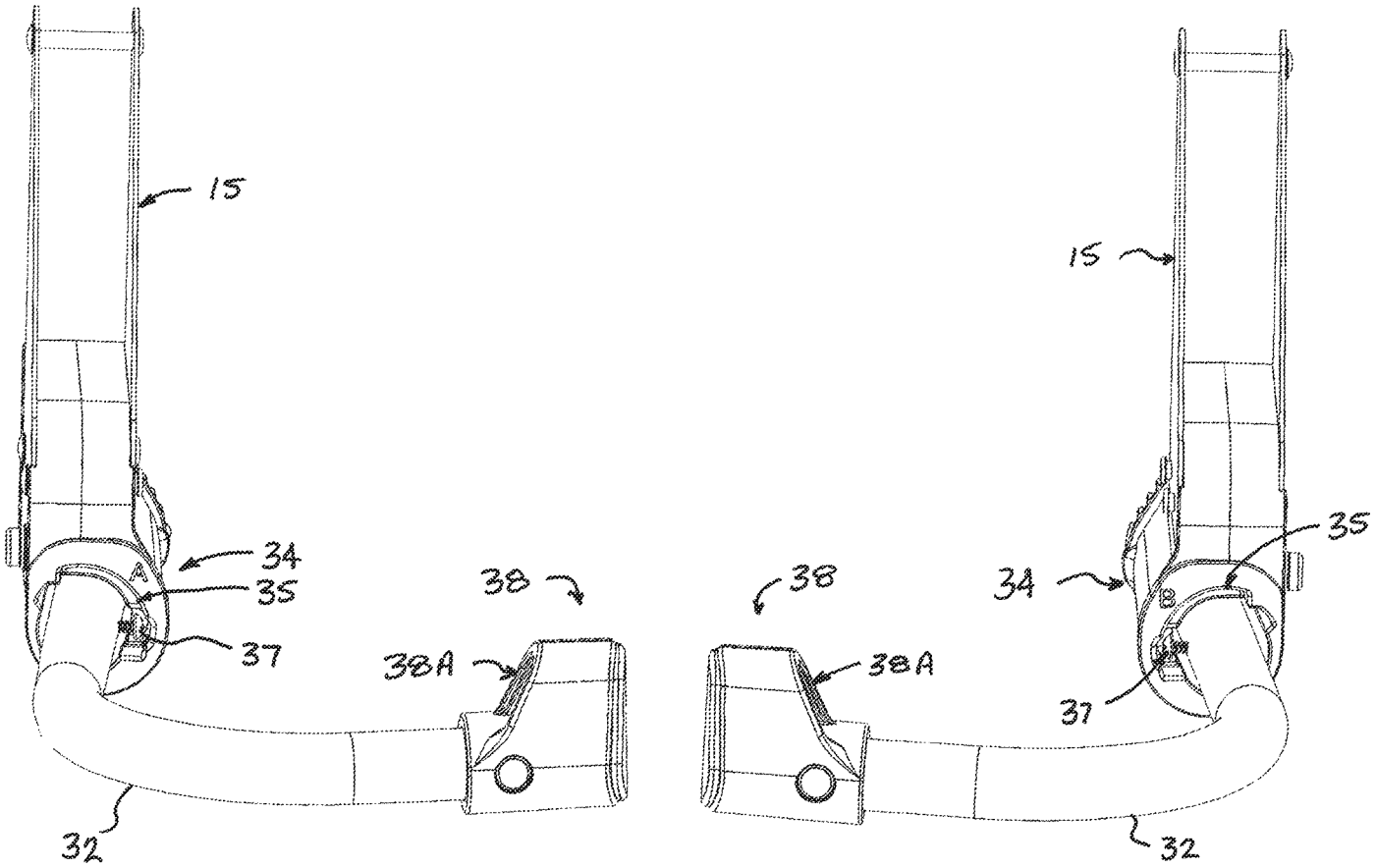

The extent of the rotational movement is limited by a travel stop 37 affixed to the second portion 14 that engages a travel limiter 35 that is affixed to the rotator connector 34, best illustrated in FIGS. 7 through 9. The extent of the rotational movement is limited by a travel stop 37 affixed to the rotator connection that is engaged by a travel limiter 35 that is affixed to the extension 32. In the exemplar, the travel stop is a fastener protecting radially from the extension tube which travels in arcuate recess formed in the rotator connector 34 into which the fastener may be disposed. It is preferable for the range of rotational movement to be limited to approximately one-quarter turn. In one embodiment, the range of rotational movement is limited to approximately 95 degrees, with the extension being generally parallel to the table surface when in the second position and the extension being approximately 5 degrees beyond perpendicular with the table when in the first position. It is also preferable to orient the respective travel limiters 35 such that the extensions 32 are rotated inwardly, towards each other (counter-rotation) as they are moved toward their respective second positions.

The inward ends 122 of the first frame portion 12 may be provided with grips 125 to increase friction between the first inward ends 122 and the upper surface 6 of the table. The grips 125 are preferably made from an elastomeric material that is relatively soft in comparison to the table 5 so that the grips protect the upper surface 6 from damage by direct contact with the inward ends 122 of the first portion; the frame portions 12, 14 are preferably metal structural members. The distal ends of extensions 32 may also include bumper grips 38, which like the grips 125, are preferably made from an elastomeric material to protect the lower surface 8 from damage due to contact with the extension 32 and to increase friction between the extension and the lower surface 8.

Figure 5:
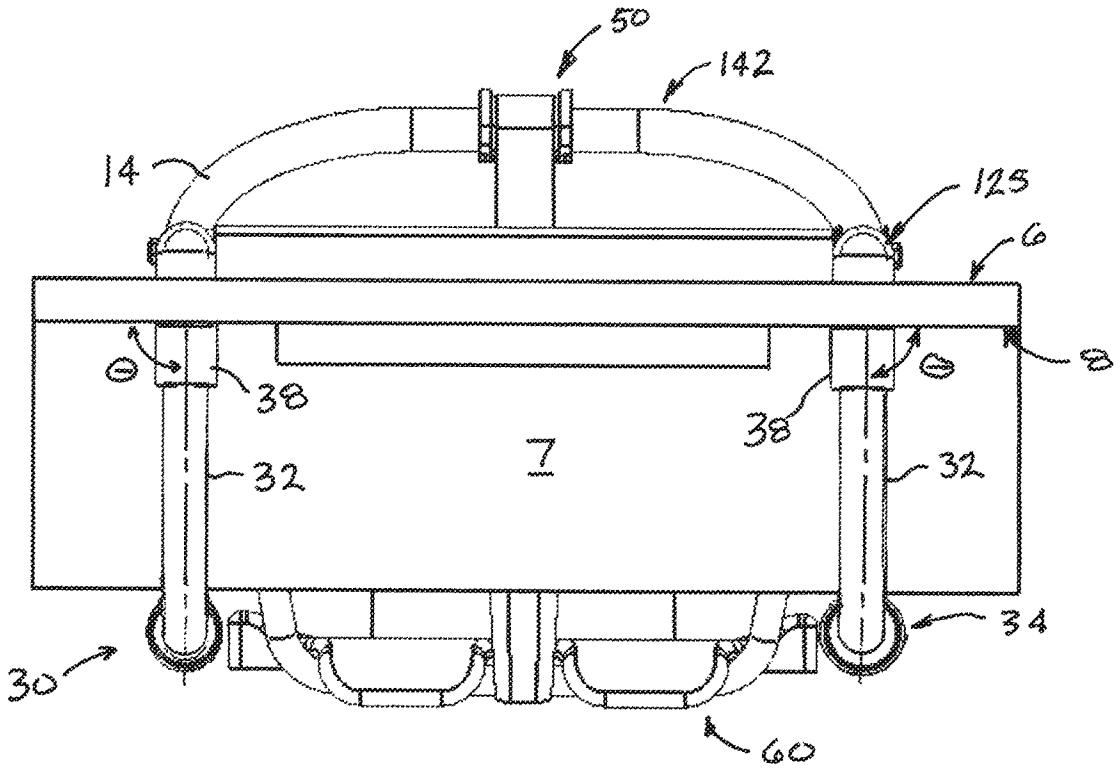
FIG. 5 is an elevation view of the foldable seat shown attached to the table.

As is best illustrated in FIG. 5, the extensions 32 may be angled slightly relative to the lower surface 8 when in the first position to improve stability and to prevent unintended movement of the extensions 32 toward the second position without requiring a latching mechanism. This is accomplished by angling the extensions 32 to an angle θ that is slightly greater (preferable by approximately 3 to 5 degrees) than 90 degrees to create an over-center arrangement of the rotational connection of the rotator connector 34. Greater values of angle θ are possible, but provided diminishing returns as the angle increases substantially beyond 5 degrees. When the frame 10 is clamped to the table, movement of the extensions 32 toward the second position requires that the extension move through the perpendicular relationship with the lower surface which requires increasing the clamping force with even as little as one or two degrees of rotation.

Figure 6:
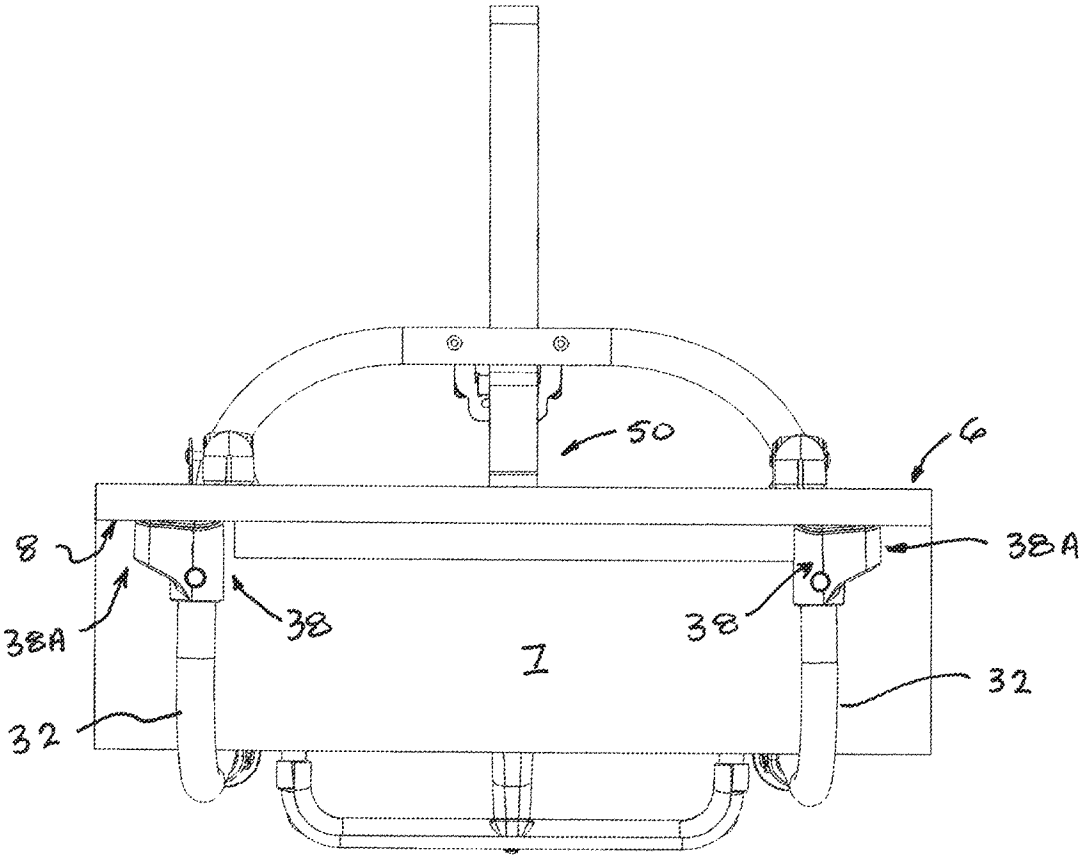
FIG. 6 shows an alternate arrangement to the configuration shown in FIG. 5 using a modified foot to create an over-center lock.

Referring to FIG. 6, an alternate arrangement for stabilizing the extensions 32 is shown wherein the extensions may remain generally perpendicular to the lower surface 8 of the table, but the bumper grips 38 are asymmetric in relation to the extensions 32. When the seat is clamped to the table, inward rotation of the extensions 32 is resisted by the over-center position of the outward portion of the asymmetric portion 38A bumper grips 38. Strength of the extensions 32 and the structure in general is improved by maintaining the extensions 32 generally perpendicular to the table. Stability may be further enhanced by combining the asymmetric bumpers 38A with the overcenter angling of the extensions 32.

A seating arrangement 60 is connected to the frame 10 and disposed adjacent to the outward ends 124, 144 to support a child adjacent to the table 5 when the seat frame 10 is secured thereto. The seating arrangement 60 may comprise a bottom support 62 and a front support 64 which collectively allow a small child to sit and be confined to the seat 10. Soft goods (not shown) typically cover portions of the frame 10 and seating arrangement 60 to comfortably support the seat occupant. The seating arrangement 60 is preferably moveably connected to the frame 10 using pivoting joints so that the seating arrangement 60 may be reconfigured into a more compact configuration as the frame 10 is folded.

Naturally, the invention is not limited to the foregoing embodiments, but it can also be modified in many ways without departing from the basic concepts. Changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A portable seat for attachment to a table to support a child thereon, the portable seat comprising:

a frame having first and second frame portions pivotally connected in a crossing, scissor-like configuration, the first and second frame portions having adjacent inward ends and adjacent outward ends and being pivotally moveable between clamped and released positions, movement of the frame portions causing the inward and outward ends to simultaneously move closer or further proximity, the inward ends of the first frame portion being in adjacent contact with an upper surface of the table when in the clamped position; and first and second elongate moveable clamping space adjusters each connected at a proximal end to the inward ends of the second frame portion, the space adjusters each moveable about a respective rotational axis between opposing first and second positions, a distal end of each space adjuster being in contact with a lower surface of the table and closest to the inward ends of the first portion when in the first position and the frame is in the clamped position, the distal end being rotated moving the distal ends away from the table so that the distal ends of the space adjusters are spaced apart from the table when in the second position, the space adjusters being angled in relation to an axis perpendicular with the table lower surface when in the first position, the angled relation inhibit rotation of the space adjusters toward the second position while the frame is in the clamped position.

2. The portable seat of claim 1, wherein the space adjusters rotate between an alignment parallel to the table when in the second position and an alignment angled in relation to an axis perpendicular with the table when in the first position, the degree of the angling being an overcenter angle.

3. The portable seat of claim 2, wherein the overcenter angle is greater than zero.

4. The portable seat of claim 3, wherein the overcenter angle is within the range of three and five degrees.

5. The portable seat of claim 4, further comprising a pivot limiter operably connected to each of the first and the second space adjusters to limit rotation in the direction toward the first position.

6. The portable seat of claim 1, wherein the first and second space adjusters rotate in opposite directions when moving from the second position toward the first position.

7. The portable seat of claim 1, wherein the first and second space adjusters each further comprise a foot asymmetrically positioned with respect to the distal end of the space adjusters, the asymmetry configured to inhibit rotation of the space adjusters from the first position toward the second position when the frame is clamped to the table.

8. The portable seat of claim 1, further comprising a tensioning apparatus connecting the outward ends of the first and second frame portions, the tensioning apparatus configured to move the respective ends toward each other and to maintain the respective distal ends of the space adjusters in the first position.

9. The portable seat of claim 8, wherein the tensioning apparatus further comprises a releasable ratchet device to selectively retain the respective outward ends in the clamped position.

10. The portable seat of claim 1, wherein the pivot connection is positioned midway between the inward and the outward ends of the first and second frame portions.

11. A portable seat attachable to a table for a supporting child comprising:

a first frame portion having generally opposing inboard and outboard ends defining a longitudinal axis therebetween, the inboard end further comprising longitudinally oriented and spaced apart first and second pivot connections;

a second fame portion having opposing inboard and outboard ends;

a hinge connecting the first and second frame portions enabling pivoting movement of the frame portions whereby the inboard and outboard ends simultaneously move closer or further apart with pivoting movement; and first and second elongate moveable adjuster members each connected at a first end to the first and second pivot connections, respectively, the moveable adjuster members being rotatable about longitudinal axes of the respective pivot connection between a first position in which respective second ends are in contact with a lower surface of the table, and a second position in which the respective second ends of the moveable adjuster members are rotated away from contact with the lower surface of the table, each pivot connection further comprises a pivot limiter operably connected to limit rotation of the respective adjuster members in the direction toward the first position.

12. The portable seat of claim 11, wherein the adjuster members rotate between an alignment parallel to the lower surface of the table when in the second position and the first position in which the adjuster members are angled in relation to an axis perpendicular to the lower surface, the degree of the angling being an overcenter angle.

13. The portable seat of claim 12, wherein the overcenter angle is greater than zero.

14. The portable seat of claim 13, wherein the overcenter angle is within the range of three and five degrees.

15. The portable seat of claim 11, wherein the first and second space adjusters rotate in opposite directions when moving from the second position toward the first position.

16. The portable seat of claim 15, wherein the space adjusters angled alignment in relation to an axis perpendicular with the table lower surface inhibits rotation of the space adjusters toward the second position while the frame is clamped to the table.

17. The portable seat of claim 11, further comprising a tensioning apparatus connecting the outboard ends of the first and second frame portions, the tensioning apparatus configured to move the respective ends toward each other and includes a releasable ratchet device to selectively retain the respective outward ends in the clamped position thereby maintaining the respective second ends of the adjuster members in contact with the lower surface of the table.

18. The portable seat of claim 11, wherein the first and second space adjusters each further comprise a foot asymmetrically positioned with respect to the distal end of the space adjusters, the asymmetry configured to inhibit rotation of the space adjusters from the first position toward the second position while the frame is clamped to the table.

* * * * *